US007802585B2

(12) United States Patent
Kolbenschlag

(10) Patent No.: US 7,802,585 B2
(45) Date of Patent: Sep. 28, 2010

(54) TRANSDUCER OF AN ELECTRICAL INPUT SIGNAL INTO PNEUMATIC OUTPUT SIGNALS

(75) Inventor: Stefan Kolbenschlag, Darmstadt (DE)

(73) Assignee: Samson Aktiengesellschaft, Frankfurt (DE)

( * ) Notice: Subject to any disclaimer, the term of this patent is extended or adjusted under 35 U.S.C. 154(b) by 0 days.

(21) Appl. No.: 11/668,192

(22) Filed: Jan. 29, 2007

(65) Prior Publication Data

US 2007/0186974 A1 Aug. 16, 2007

(30) Foreign Application Priority Data

Feb. 13, 2006 (DE) ..... 10 2006 006 585

(51) Int. Cl.
*F15B 5/00* (2006.01)

(52) U.S. Cl. ..... 137/83; 137/82

(58) Field of Classification Search ..... 137/82, 137/83, 84, 85, 86, 489, 489.5
See application file for complete search history.

(56) References Cited

U.S. PATENT DOCUMENTS 2,832,365 A * 4/1958 Smith ..... 137/82
3,176,593 A * 4/1965 Bernstein ..... 91/459
3,562,521 A * 2/1971 Vanderschmidt et al. .... 250/384
3,570,407 A * 3/1971 Burch ..... 104/242
3,782,246 A * 1/1974 Hilbrands ..... 91/277
4,031,813 A * 6/1977 Walters et al. ..... 91/433
4,416,146 A * 11/1983 Ambrose ..... 73/49.5
4,509,403 A * 4/1985 Gassman et al. ..... 91/365
4,579,137 A * 4/1986 Brandt, Jr. ..... 137/85
4,855,659 A * 8/1989 Riensche ..... 318/645
5,012,722 A * 5/1991 McCormick ..... 91/361
5,172,547 A * 12/1992 Lawrence et al. ..... 60/234
5,564,306 A * 10/1996 Miller ..... 73/861
5,678,601 A * 10/1997 Engel ..... 137/486
5,999,868 A * 12/1999 Beno et al. ..... 701/37
6,644,332 B1 * 11/2003 Winkler ..... 137/2
2002/0066480 A1 * 6/2002 Anderson ..... 137/82
2004/0016361 A1 * 1/2004 Teichmann et al. ..... 105/164
2004/0096368 A1 * 5/2004 Davis et al. ..... 422/104
2005/0172794 A1 * 8/2005 Hoffmann et al. ..... 91/361
2006/0118169 A1 * 6/2006 Junk ..... 137/82

* cited by examiner

*Primary Examiner*—Kwok C. Wong
*Assistant Examiner*—William McCalister
(74) *Attorney, Agent, or Firm*—Schiff Hardin LLP

(57) ABSTRACT

In a transducer of at least one electrical input signal into two separate magnetic output signals for a pneumatic actuator, a pressure input is connected to a source of pressure and a setting unit sets the pneumatic output signals by use of the electrical input signal. The setting unit provides the two pneumatic output signals separately and reciprocal to each other as a function of the input signal. At least one of the two output signals is connected to a pneumatic amplifier.

11 Claims, 3 Drawing Sheets

TRANSDUCER OF AN ELECTRICAL INPUT SIGNAL INTO PNEUMATIC OUTPUT SIGNALS

BACKGROUND

The preferred embodiment relates to a transducer of an electrical input signal into a pneumatic output signal, particularly an I/P (current/pressure) transducer or transformer for a pneumatic actuator, For operating a pneumatic actuator it is known in a so-called pilot stage usually formed by an I/P transducer to generate a control pressure signal which, when amplified by a pneumatic amplifier, is applied to a working chamber of the pneumatic actuator which is correspondingly expanded or contracted. A movable working chamber wall is connected to a reciprocating rod or a positioning shaft, by means of which a final control element such as a safety valve is positioned in accordance with the motion of the working chamber wall. Such pneumatic actuators are put to use for example in process control systems in the chemical industry.

The I/P transducer usually receives from a positioner an electrical control signal. The I/P transducer has a nozzle-flapper assembly which transduces the electrical control signal into a pneumatic pilot signal of, for example, 0.2 to 1 bar which is amplified by the pneumatic amplifier into a main control pressure of 1 to 6 bar to be applied to the pneumatic actuator.

In addition to single-acting pneumatic actuators defined by a single pneumatic working chamber defined by a diaphragm biased by a return spring, so-called double-acting pneumatic actuators are also known defined by two counter-acting working chambers separated by a wall.

To enable the pneumatic working chambers the electrical control signal is transduced in the I/P transducer into a pneumatic pilot signal which is supplied to both a first pneumatic amplifier and a second pneumatic amplifier, the latter serving as a reversing amplifier. Since the one pneumatic amplifier is connected to a pneumatic chamber and the reversing amplifier to the other pneumatic chamber of the double-acting pneumatic actuator the desired reciprocal air pressure application of the working chambers is achieved.

One drawback in enabling the double-acting pneumatic actuator is that the characteristics of the pneumatic amplifier and of the pneumatic reversing amplifier cannot be set each independently of the other. One possibility of achieving independent setting of the characteristics in a double-acting pneumatic actuator is to make use of two I/P transducers each of which can be separately enabled or controlled. This, however, requires an increased electrical power supply which, in view of a safety relevant ignition protection design, in particular a type of protection "e" design, of pneumatic actuators is to be avoided.

SUMMARY

An object is to provide an I/P transducer or transformer with which controllability of the pneumatic working chamber is enhanced, A transducer of at least one electrical input signal into two separate pneumatic output signals for pneumatic actuators is provided. A pressure input is connected to a source of pressure and a setting unit sets pneumatic output signals by use of the electrical input signal. The setting unit is designed to generate the two pneumatic output signals separately and reciprocal to each other as a function of the input signal.

DESCRIPTION OF THE PREFERRED EMBODIMENT

Figure 1:
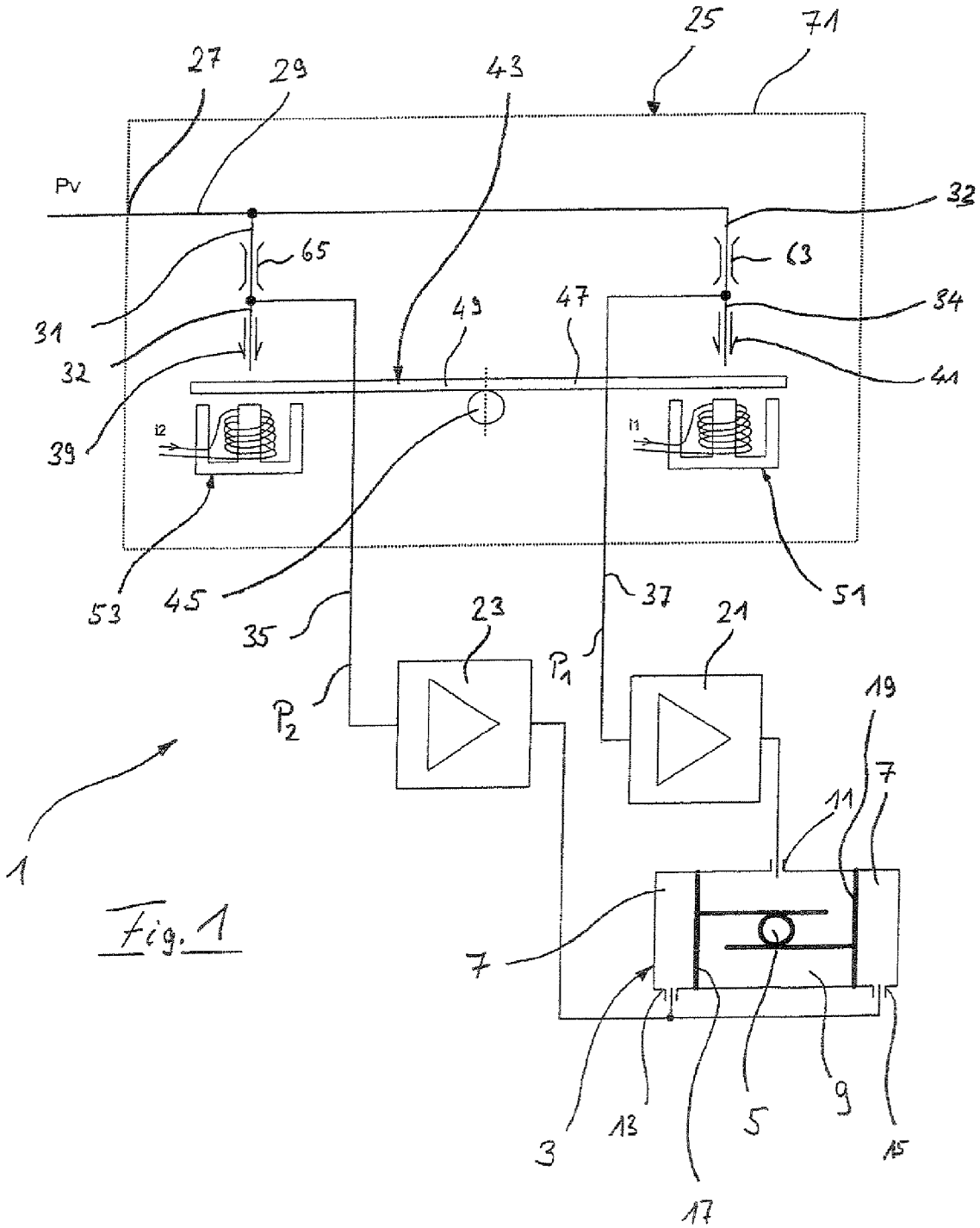
FIG. 1 is a block circuit diagram of a pneumatic actuator system with an I/P transducer in accordance with the preferred embodiment, two pneumatic amplifiers and a pneumatic actuator.

For the purposes of promoting an understanding of the principles of the invention, reference will now be made to the preferred embodiment and variations thereof illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

Accordingly, there is provided a pneumatic pre-stage, namely a transducer or transformer, more particularly an I/P transducer, for a pneumatic actuator, the transducer being connected to a source of pressure particularly with a constant pressure and comprising a mechanism for setting a pneumatic output signal by way of one, preferably two, electrical input signal(s). The output signal of the transducer is supplied to a pneumatic main stage, namely a pneumatic amplifier before being supplied to the working chamber of the actuator. In accordance with the preferred embodiment the mechanism of the transducer is designed to generate two separate pneumatic output signals which as a function of one, or preferably two, separate input signal(s) are reciprocal, meaning that the one output signal pressure is reduced when the second separate output signal pressure increases. Which output pressures are generated in the transducer depends on the electrical input signal fed into the transducer, particularly from the two input signals. The output pressures are each made available to two separate outputs of the transducer which can be connected either to a single, or to each pneumatic amplifier.

Making available a pneumatic output signal in accordance with the preferred embodiment already in the pneumatic pre-stage now makes it possible to alter the characteristic of the transducer, particularly its output pressures, by setting the reciprocal ratio between the pneumatic output signals. The transducer in accordance with the preferred embodiment is suitable for so-called double-acting pneumatic actuators, the two working chambers of which are supplied with differing, more particularly reciprocal working pressures.

In one preferred aspect of the preferred embodiment the mechanism comprises two separate pneumatic inner conduits connected to the source of pressure, particularly with the pressure input, each connected to the corresponding output. In addition two final control elements are assigned to each of the pneumatic inner conduits so that the pneumatic pressure can be varied at the output of each pneumatic conduit. In this arrangement, the final control elements are designed to position reciprocally. For example, the final control elements may be designed such that the cross-section of each pneumatic conduit is varied correspondingly reciprocally depending on with which electrical input signal the final control element is controlled.

Preferably at least one final control element, particularly both final control elements, are each controlled by an electrical input signal.

In one particularly preferred aspect of the preferred embodiment the mechanism comprises a nozzle-flapper assembly with two nozzles each connected to the pressure input and forming the end of a branching conduit from the pneumatic inner conduits. In this arrangement the flapper is positioned relative to the nozzles such that they open and close reciprocally as well as being able to assume intermediate positions. Each final control element is designed to realize reciprocal opening and closing and thus varying the cascade pressures at the nozzles. For this purpose the corresponding final control element can position the flapper or each single flapper assigned to a nozzle To permit setting the cascade pressure calibratingly at each nozzle, each nozzle is connected in series ante a restrictor which may be an adjusting throttle or a variable restrictor.

In one preferred further embodiment of the preferred embodiment the flapper of the nozzle-flapper assembly is formed integral and facing both nozzles. To achieve the reciprocal response of the transducer at its pneumatic outputs, the flapper of the nozzle-flapper assembly can be mounted like a rocker, whereby each flapper rocker arm can be assigned to a nozzle. Preferably each rocker arm is engaged by a final control element to position the flapper relative to the corresponding nozzle.

In another aspect of the preferred embodiment, at least one final control element, preferably both final control elements, comprise(s) an electromagnetic actuator, the electrical input signal, preferably two input signals supplied separately to the two final control elements being made use of such that the electromagnetic actuator(s) is/are both controlled and energized.

Preferably the rocker mount of the flapper is positioned such that when the electromagnetic actuators are disabled the cascade pressures at the nozzles are substantially equal. This achieves that when the pneumatic actuator has been corrected to zero, i.e. no change in the position of the final control element to be moved by the pneumatic actuator is needed, the transducer is disabled and accordingly power consumption of the transducer is zero. This advantage is especially important with high-safety pneumatic actuators in which special proof requirements need to be satisfied.

In yet another aspect of the preferred embodiment, one of the final control elements is realized by a compression or tension spring and the other final control element by an electromagnetic actuator. In this arrangement the compression or tension spring can act on the rocker mounted flapper such that when the actuator is disabled one nozzle is closed and the other nozzle is fully open. In this aspect only one electromagnetic actuator is needed. The compression or tension spring engages one side of the rocker mount while the electromagnetic actuator acts on the other side.

In still another preferred aspect of the preferred embodiment, the transducer is realized as a module or structural unity employed as a pre-stage for a pneumatic actuator system wherein the mechanism can be housed in a sealed enclosure, accommodating, for example, the pneumatic inner conduits, the final control elements, the nozzle-flapper assembly, etc. The pneumatic amplifier, the main stage is to be located remote from the enclosure.

The preferred embodiment relates furthermore to a pneumatic actuator with two pneumatic working chambers each separate from the other, whereby one pneumatic amplifier connects the corresponding pneumatic working chamber in each case and a transducer in accordance with the preferred embodiment whose pneumatic outputs are connected to the respective pneumatic amplifier.

Referring now to FIG. 1 there is illustrated a pneumatic actuator system in accordance with the preferred embodiment identified by reference numeral 1. The pneumatic actuator system 1 comprises a pneumatic actuator 3 which in this case takes the form of a pivoting actuator with an actuator shaft 5. The pneumatic actuator 3 comprises two working chambers 7 and 9, each of which has one (11) or two (13, 15) air inlets.

To operate the pneumatic actuator 3 the working chambers 7 and 9 are variably air powered. An increase in the internal pressure in the working chamber 9 with a corresponding reciprocal reduction in the working pressure in the working chambers 7 causes the partitions 17, 19 to be displaced outwardly, torquing the actuator shaft 5. A valve (not shown) connected to the actuator shaft 5 as may be integrated in a chemical processing plant is correspondingly positioned.

The inlets 11 and 13, 15 are each connected to a pneumatic amplifier 21, 23, both of which are input to the same I/P transducer 25 in accordance with the preferred embodiment.

The I/P transducer 25 has a pneumatic input 27 connected to a source (not shown) of a constant supply pressure $P_v$ (for example 1 bar).

In the I/P transducer 25 a pneumatic input conduit 29 branches into two pneumatic conduits 31, 33, each of which is connected via a pneumatic connecting conduit 35, 37 to the pneumatic amplifier 23, 21.

The pneumatic conduits 31, 33 (not shown in FIG. 2*a*) also port into branching conduits 32, 34 each of which ends in an outlet nozzle 39, 41. The outlet nozzles 39, 41 face a flapper 43 mounted on a rocker-type mount 45. The flapper 43 comprises two equally long rocker arms 47, 49, rocker arm 47 being assigned to outlet nozzle 41 and rocker arm 49 to outlet nozzle 39. The air jetted by the outlet nozzles 39, 41 torque the flapper 43 about the mount 45.

Figure 2A:
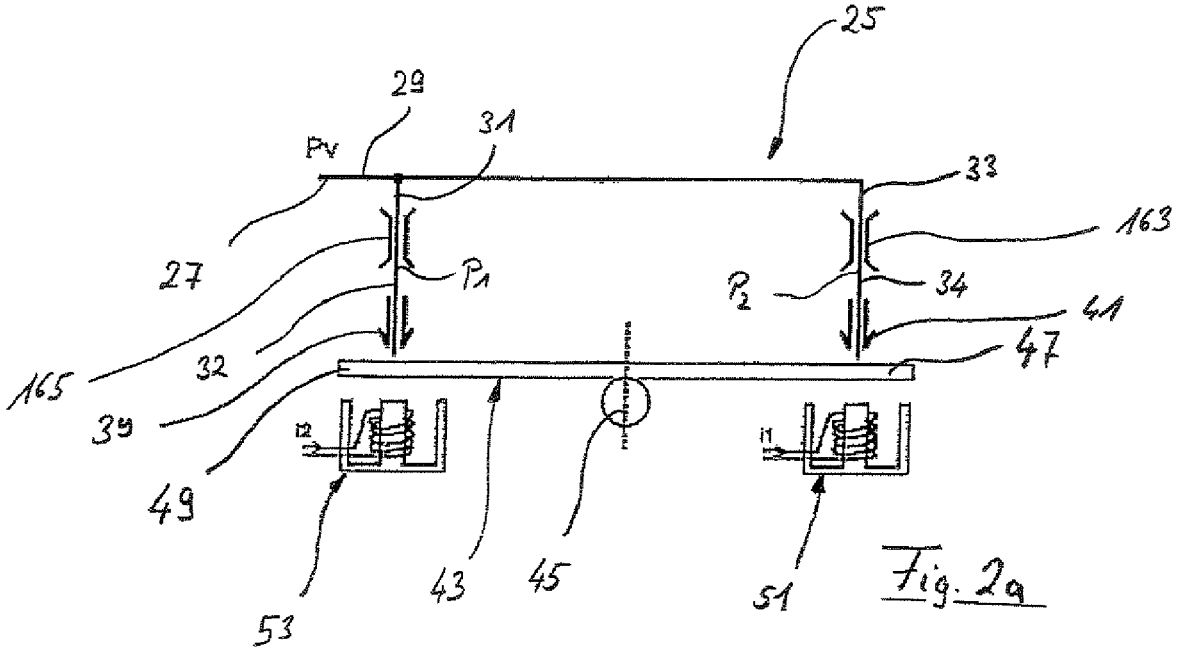
FIG. 2*a* is a block circuit diagram of the transducer in accordance with the preferred embodiment as shown in FIG. 1.

Referring now to FIGS. 1 and 2*a* there is illustrated at the side of the flapper 43 facing away from the outlet nozzle 39, 41 how in the case of the I/P transducer 25 two electromagnetic actuators 51, 53 with a metal core/coil assembly are positioned facing the outlet nozzles 39, 41 respectively. The electromagnetic actuators 51, 53 are controlled and energized by two electrical input signals i1 and i2. The electromagnetic actuators 51, 53 generate a magnetic field which acts correspondingly in positioning fashion on the magnetic flapper 43.

When the operating condition of the pneumatic actuator 3 has been corrected to zero the electrical input signals i1, i2 are zero so that the working chambers 7 and 9 are pressure-equalized, resulting in no positioning of the actuator shaft 5 and thus of the valve (not shown) to be operated by the pneumatic actuator 3.

In accordance with the invention the electromagnetic actuators 51, 53 have a reciprocal response, i.e. when energizing current i1 is changed, the other energizing current i2 remains unchanged. Accordingly, the rocker mounted flapper 43 is attracted to the electromagnetic actuator 51 when energizing current i1 is stronger, resulting in the outlet nozzle 41 jetting stronger than outlet nozzle 39 which due to the attracted flapper 43 is closed harder. It is in this way that the pneumatic amplifier 21 receives via the connecting conduit 37 a weaker pneumatic outer signal $P_1$ than that ($P_2$) of the pneumatic amplifier 23 via the connecting conduit 35, so that the working chamber 9 of the pneumatic actuator 3 features a lower internal pressure than that of the working chamber 7 and the partitions 17, 19 are displaced inwards, resulting in the actuator shaft 5 being torqued clockwise.

Depending on the dimensioning of the energizing currents i1 and i2 the rocker mounted flapper reciprocates relative to the respective nozzle 39, 41 in thus altering the working pressure within the working chambers 7, 9.

Figure 2B:
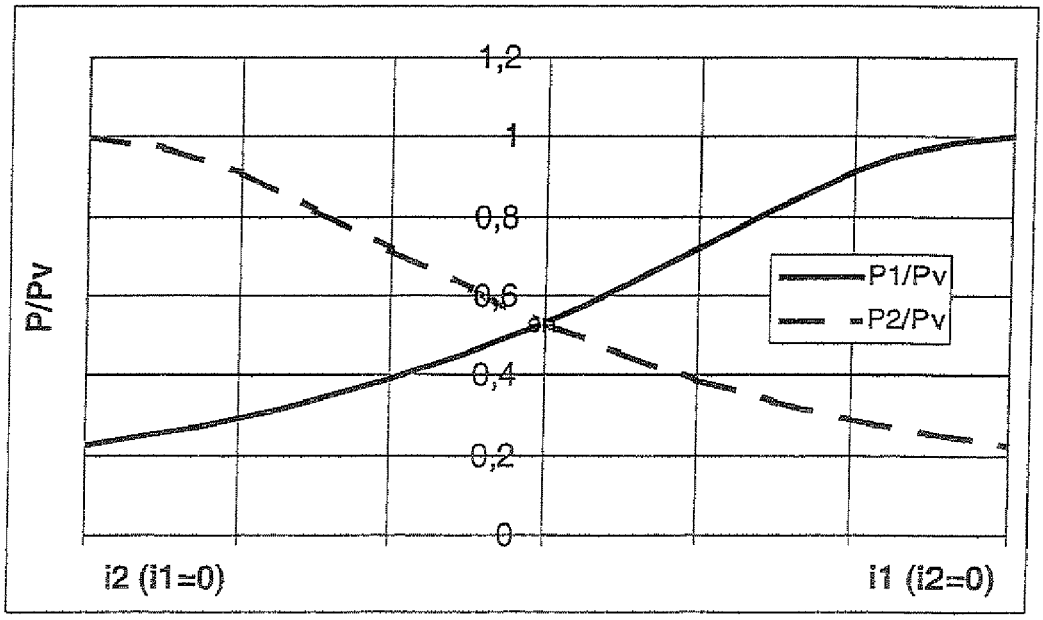
FIG. 2*b* is a graph showing the characteristic curves of the pneumatic output signals of the transducer in accordance with the preferred embodiment as shown in FIG. 2*a;*

Referring now to FIG. 2*b* there is illustrated an example of the characteristic curve (showing current; versus pressure $P_1/P_v$ or $P_2/P_v$ proportionally) of the pneumatic output pressures $P_1$ and $P_2$ relative to the supply pressure $P_v$ corresponding to the aspect of the transducer as shown in FIG. 2*a*. The characteristic of the pneumatic output $P_1$ is shown bold whereas the characteristic of the output pressure $P_2$ is indicated as a broken line, clearly showing the reciprocal response of the output pressures $P_1$ and $P_2$. Each output pressure $P_1$, $P_2$ corresponds to the supply pressure $P_v$ when the other energizing current in each case equals zero. If the energizing currents are to be equal or preferably both zero, the pressure in the pneumatic connecting conduits 35, 37 is the same, corresponding to roughly half or a fraction of the supply pressure $P_v$.

Figure 3A:
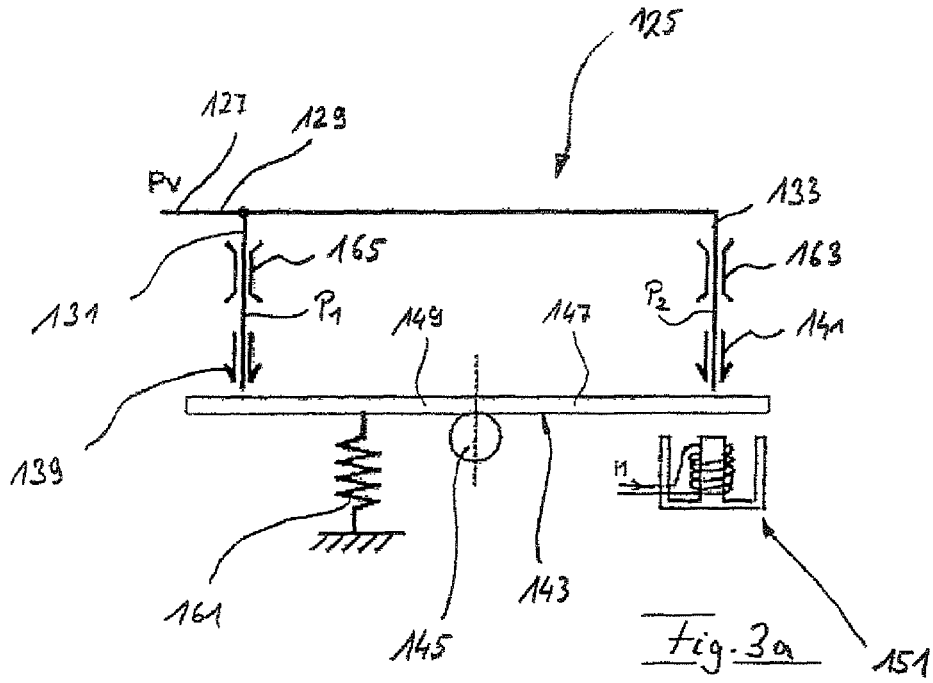
FIG. 3*a* is a block circuit diagram of an alternative aspect of an I/P transducer in accordance with the preferred embodiment.

Referring now to FIG. 3*a* there is illustrated an alternative aspect of the I/P transducer, noting that like components are identified by like reference numerals as in FIGS. 1 and 2*a* but elevated by 100.

Figure 3B:
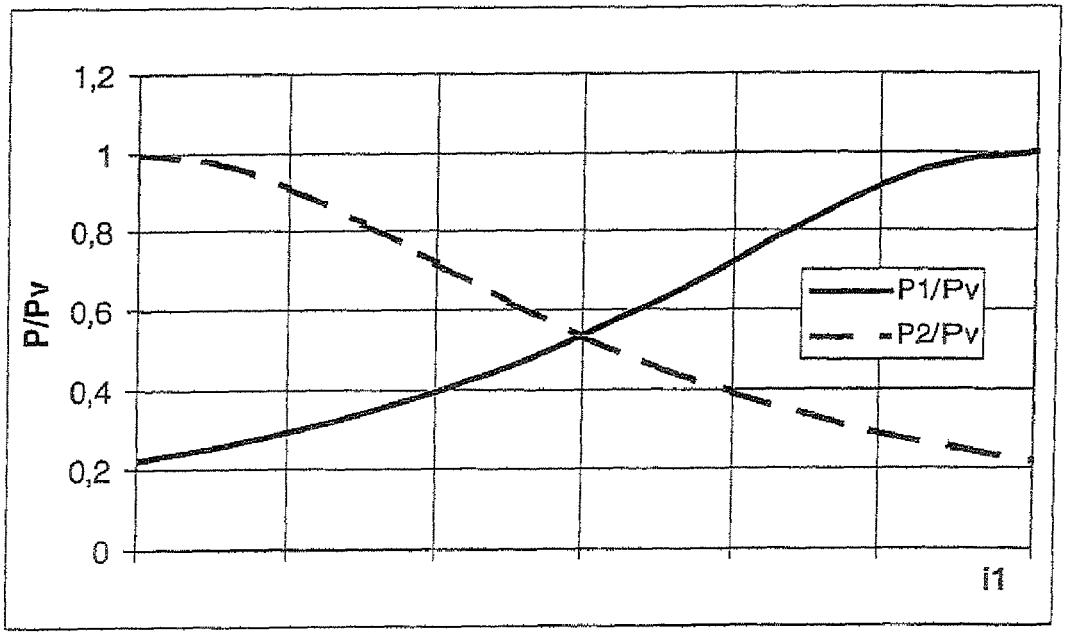
FIG. 3*b* is a graph showing the characteristic curves of the pneumatic output signals of the I/P transducer in accordance with the preferred embodiment as shown in FIG. 3*a.*

The I/P transducer 125 as shown in FIG. 3 differs from the transducer 25 as shown in FIG. 1 and FIG. 2*a* in that instead of two electromagnetic actuators (51, 53) only one electromagnetic actuator 151 and a spring 161 are provided. The electromagnetic actuator 151 is assigned to the outlet nozzle 141, the spring 161 engaging the rocker arm 149 therein being assigned to the outlet nozzle 139.

In this arrangement the spring 161 is tensioned such that when the electromagnetic actuator 151 is de-energized the nozzle 139 is fully open so that the output pressure $P_1$ substantially corresponds to the supply pressure $P_v$ as evident from the characteristic curve as shown in FIG. 3 showing the characteristic curves for the output pressure $P_1$ and $P_2$ relative to the alternative aspect of I/P transducer 125 shown in FIG. 3*a*.

Here too, the reciprocal response of output pressures $P_1$ and $P_2$ is clearly evident. In this aspect of the transducer 125 only one energizing current i1 is needed.

In both aspects as cited above one restrictor 163, 165 of each outlet nozzle 39, 41, 139, 141 respectively is arranged upstream of the branching to the connecting conduit 35, 37, the restrictors 163, 165 making it possible to tweak, calibrate, etc the outlet nozzles 39, 41,139; 141, the electromagnetic actuators 51, 53, 153 and/or the tension spring 161.

As regards the assembly of the two aspects in accordance with the preferred embodiment the person skilled in the art will appreciate that the transducer 25, 125 is suitable for a modular assembly to attain differing individual characteristics for the output pressures $P_1$ and $P_2$ as may be useful in enabling the pneumatic actuator 3.

The transducer 25, 125 comprises an enclosure 71 accommodating all components such as flapper, outlet nozzles, electromagnetic actuators, etc. The pneumatic amplifiers 21, 23 are sited outside of the enclosure 71

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A pneumatic actuator system, comprising:

a pneumatic actuator having two inputs;

two pneumatic amplifiers;

an electro-pneumatic transducer, said transducer comprising a single rotating flapper, a pressure input connected to a source of pressure and two pneumatic outputs each having a respective pneumatic output signal, a setting unit comprising said single rotating flapper setting the pneumatic output signals by use of and proportional to at least one electrical input signal, the setting unit being designed to generate the two pneumatic output signals separately and reciprocal to each other as a function of the at least one electrical input signal by use of the single flapper, each of the two pneumatic output signals being connected as a respective pneumatic input signal to a respective input of the respective pneumatic amplifier whose respective output is connected to one of the respective inputs of said pneumatic actuator, the two pneumatic amplifiers being separate from each other; and said pneumatic actuator comprising a rotating actuator shaft and first and second pneumatic working chambers, each separate from the other, the output of one of the separate pneumatic amplifiers connecting to the first working chamber and the output of the other separate pneumatic amplifier connecting to the second pneumatic working chamber.

2. A system of claim 1 wherein the setting unit has connected to the pressure source two separate pneumatic conduits connected to each pneumatic output and two control elements setting a pneumatic pressure at an output of each pneumatic conduit, the two control elements having a reciprocal response.

3. A system of claim 1 wherein at least one control element is controlled by the electrical input signal.

4. A system of claim 1 wherein the setting unit comprises a nozzle-flapper assembly formed of said single rotating flapper with two nozzles connected to the pressure input, pressure being variable at the nozzles by use of respective control elements.

5. A system of claim 4 wherein each nozzle has a variable restrictor before an input thereof.

6. A system of claim 4 wherein the nozzle-flapper assembly comprises said single rotating flapper comprising first and second rocker arms, the single rotating flapper being rocker mounted, and each rocker arm of the single flapper is assigned one of the nozzles, and a respective one of the control elements engaging each of the rocker arms for positioning the flapper.

7. A system of claim 2 wherein two of said electrical input signals are provided, and each of the control elements comprises an electromagnetic actuator controlled and energized by a respective one of the electrical input signals.

8. A system of claim 7 wherein the setting unit comprises said single flapper and a respective nozzle adjacent each respective end of the flapper, and a rocker mount of said flapper is positioned such that when the electromagnetic actuators are de-energized pressures at the nozzles are substantially equal.

9. A system of claim 2 wherein one of the control elements comprises a spring and the other control element comprises an electromagnetic actuator.

10. A system of claim 9 wherein the spring acts on said single flapper which is rocker mounted with a respective nozzle at each respective end of the flapper, and such that when the actuator is de-energized one nozzle is closed and the other nozzle is open.

11. A system of claim 2 wherein the setting unit has a nozzle flapper assembly comprising said single flapper, and the setting unit, the control elements, and said nozzle-flapper assembly are housed together in a housing.

* * * * *